US011267690B2

(12) United States Patent
Benetti

(10) Patent No.: US 11,267,690 B2
(45) Date of Patent: Mar. 8, 2022

(54) BIT FOR HORSES

(71) Applicant: AMAHORSE TRADING S.r.l., San Giustino (IT)

(72) Inventor: Mauro Benetti, Lonato del Garda (IT)

(73) Assignee: AMAHORSE TRADING S.R.L., San Giustino (IT)

( * ) Notice: Subject to any disclaimer, the term of this patent is extended or adjusted under 35 U.S.C. 154(b) by 99 days.

(21) Appl. No.: 16/642,411

(22) PCT Filed: Aug. 30, 2018

(86) PCT No.: PCT/IB2018/056613
§ 371 (c)(1),
(2) Date: Feb. 27, 2020

(87) PCT Pub. No.: WO2019/043606
PCT Pub. Date: Mar. 7, 2019

(65) Prior Publication Data

US 2020/0231427 A1 Jul. 23, 2020

(30) Foreign Application Priority Data

Sep. 1, 2017 (IT) ..... 102017000098334

(51) Int. Cl.
*B68B 1/06* (2006.01)

(52) U.S. Cl.
CPC ..... *B68B 1/06* (2013.01)

(58) Field of Classification Search
CPC ..... B68B 1/06
USPC ..... 54/7–9
See application file for complete search history.

(56) References Cited

U.S. PATENT DOCUMENTS

| | | | | |
|---|---|---|---|---|
| 51,151 A | | 11/1865 | Day | |
| 2,460,912 A | | 2/1949 | Wagner et al. | |
| 5,813,201 A | * | 9/1998 | Hsi-Chang | B68B 1/06 54/7 |
| 2002/0007619 A1 | * | 1/2002 | Myler | B68B 1/06 54/7 |

FOREIGN PATENT DOCUMENTS

| | | | | |
|---|---|---|---|---|
| DE | 20003617 U1 | | 4/2001 | |
| GB | 154419 A | | 12/1920 | |
| GB | 1580584 A | * | 12/1980 | B68B 1/06 |
| GB | 2315006 A | * | 1/1998 | B68B 1/06 |

OTHER PUBLICATIONS

International Search Report, issued in PCT/IB2018/056613, dated Nov. 30, 2018, Rijswijk, Netherlands.

* cited by examiner

*Primary Examiner* — Peter M Poon
*Assistant Examiner* — Danielle A Clerkley
(74) *Attorney, Agent, or Firm* — Arent Fox LLP; Michael Fainberg

(57) ABSTRACT

A bit for horses comprising a central element, suitable for being inserted into a horse's mouth, and a pair of side rings, each side ring being connected to a respective end of the central element for connecting to the reins is provided. The central element is made of a plastic material and the ends of the central element are overmolded on coupling portions of the respective side rings.

8 Claims, 3 Drawing Sheets

BIT FOR HORSES

CROSS-REFERENCE TO RELATED APPLICATIONS

This application is a National Phase Application of PCT International Application No. PCT/IB2018/056613, having an International Filing Date of Aug. 30, 2018 which claims priority to Italian Application No. 102017000098334 filed Sep. 1, 2017, each of which is hereby incorporated by reference in its entirety.

FIELD OF THE INVENTION

The present invention concerns a bit for horses.

BACKGROUND OF THE INVENTION

As is well known, a horse bit generally comprises a central element, for example made of metal, possibly articulated, suitable for insertion into the mouth of the horse, and at least one pair of side rings, each attached at one end of the central element for connecting to the reins.

In one known embodiment, each ring is free to slide through a hole made in the end of the central element.

In order to protect the lip of the horse from contact with the ring and, in particular, to prevent the lip from getting caught at the coupling point between the central element and the ring, e.g. in the ring hole, a bit guard is fitted on each end of the central element. Such bit guard is in practice a disc wherein is made a circular opening in which the central element is inserted.

SUMMARY OF THE INVENTION

One object of the present invention is to propose a bit particularly comfortable for horses, which is able to prevent the lip or tongue of the horse from being pinched between the side ring and the central element.

Another object of the invention is to provide a bit that allows smooth and, at the same time, safe control of the horse.

A further object of the invention is to propose a bit with a light structure, composed of a reduced number of components and economical to manufacture.

Such objectives are achieved by a bit and the method for making bits having the features described below. Preferred embodiments of the invention are also described.

BRIEF DESCRIPTION OF THE DRAWINGS

The features and advantages of the bit according to the invention will, in any case, become evident from the description provided hereinafter of the preferred embodiments thereof, provided by way of indicative and non-limiting examples, with reference to the accompanying figures, wherein.

DETAILED DESCRIPTION

Figure 1:
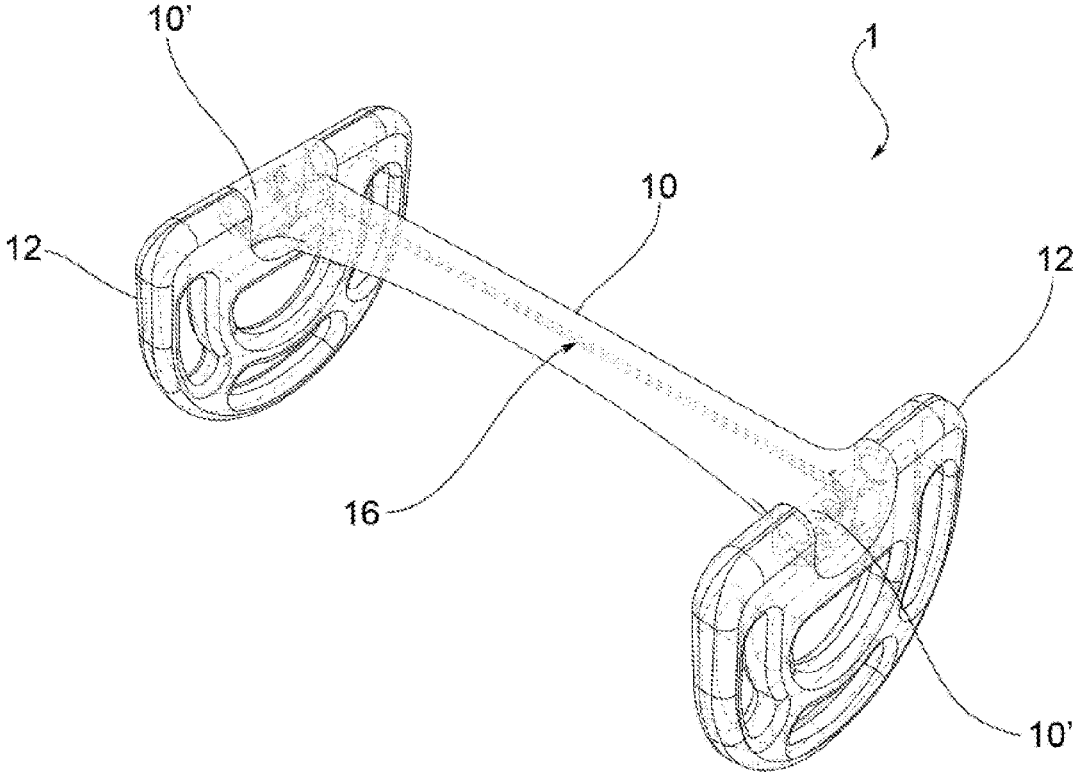
FIG. 1 is a perspective view of the bit according to the present invention.
Figure 2:
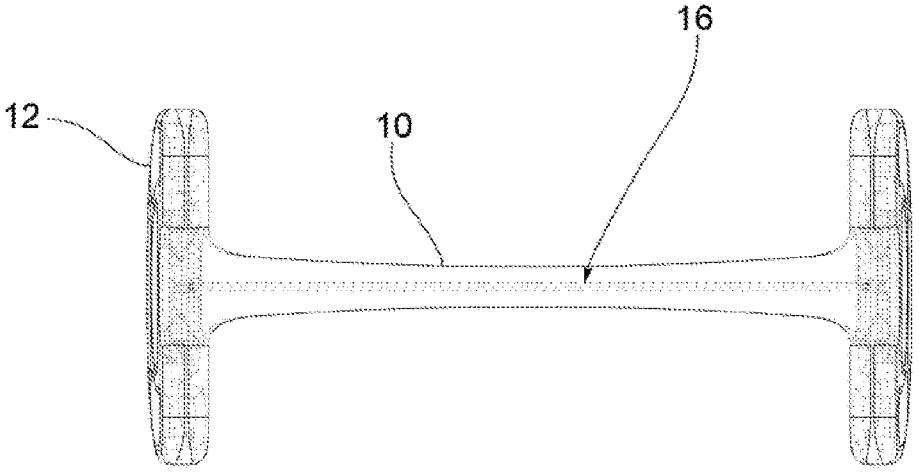
FIG. 2 is a front view of the bit.
Figure 3:
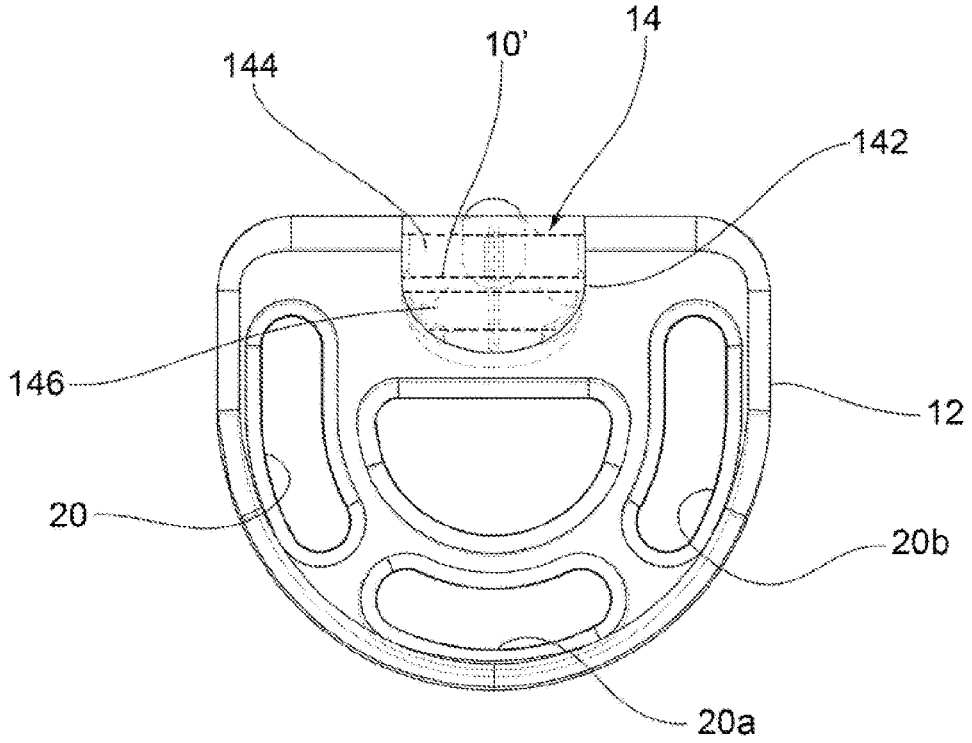
FIG. 3 is an end view of the bit.
Figure 4:
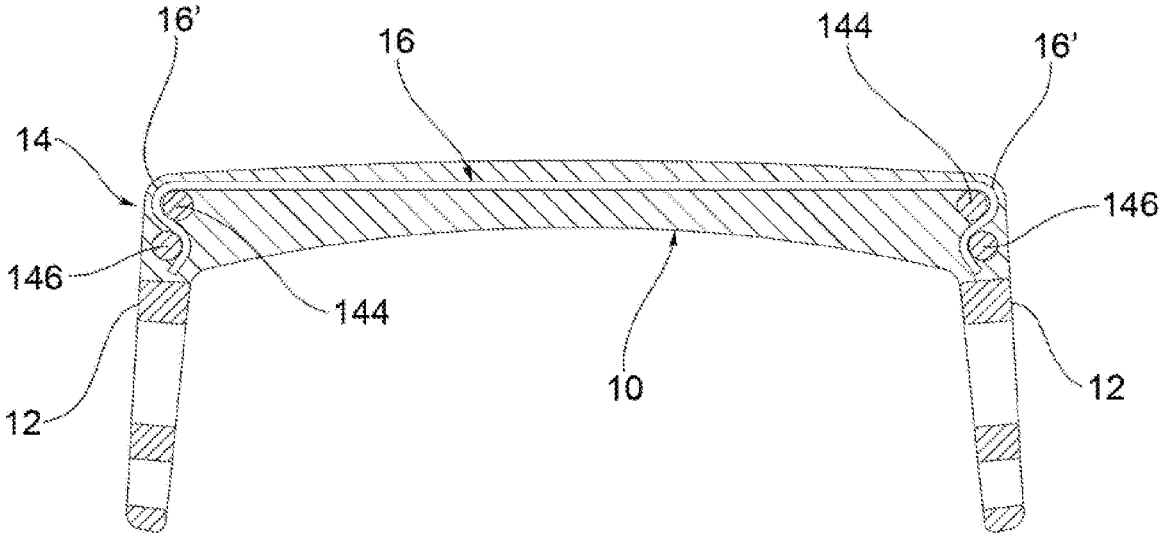
FIG. 4 is another front view of the bit in partial cross-section.
Figure 5:
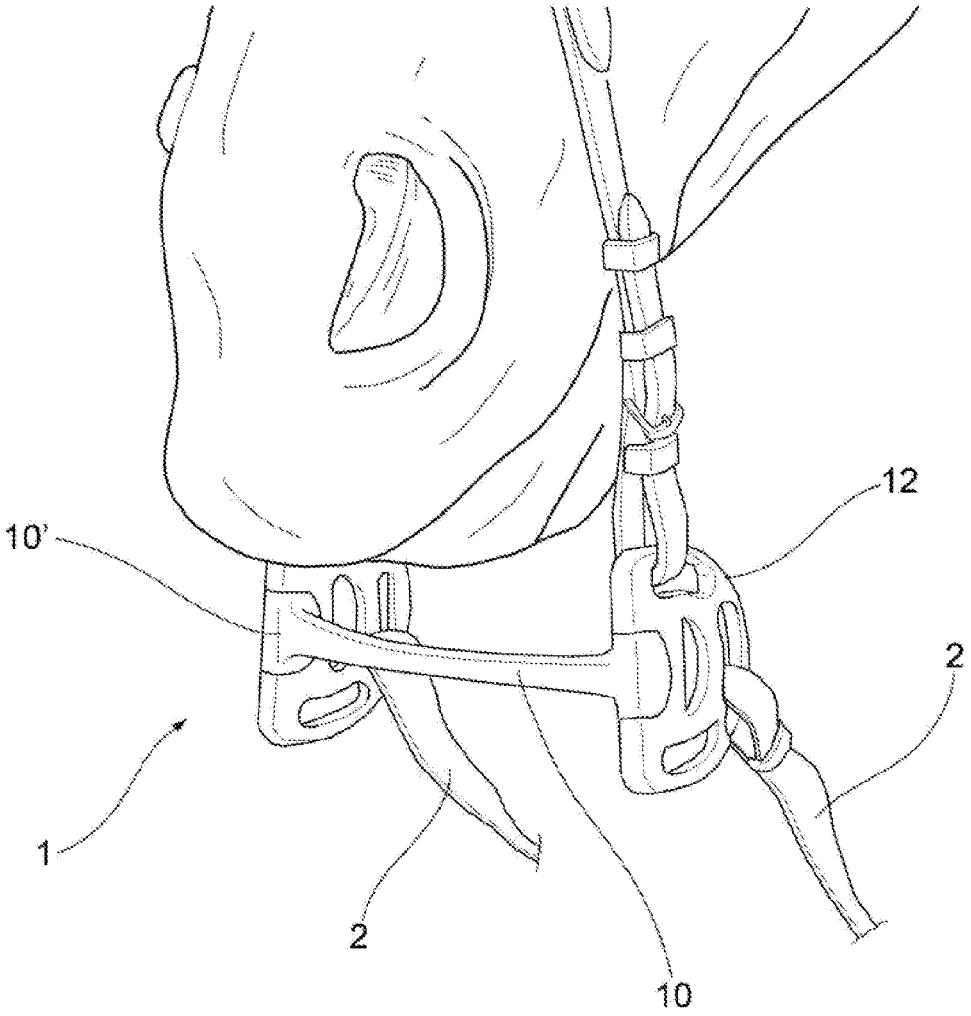
FIG. 5 shows the bit in use.

In said drawings, a bit for horses according to the invention has been indicated collectively at 1.

In a general embodiment, the bit 1 comprises a central element 10, suitable for insertion into the mouth of the horse, and a pair of side rings 12, each connected to a respective end 10' of the central element for connecting to the reins 2.

In accordance with one aspect of the invention, the central element 10 is made of a plastic material and the ends 10' of the central element are overmolded onto coupling portions 14 of the respective side rings 12.

In one embodiment, the central element 10 consists of a straight bar or, preferably, one slightly curved towards the corners of the horse's mouth.

In one embodiment, the central element 10 gradually tapers towards the center. Moreover, preferably, such central element 10 is flattened in the direction of closing of the horse's jaws.

In one embodiment, the side rings 12 form an angle equal to or greater than 90° with the central element 10. Preferably, the side rings 12 are slightly divergent so as to follow the anatomy of the horse's muzzle, which progressively widens toward the neck.

In one embodiment, each side ring 12 is also made of a plastic material, e.g. nylon. However, the side rings 12 could also be made of a metallic material suitable for coupling to the plastic material of the central element.

If both the central element 10 and the side rings 12 are made of plastic, the plastic material of the central element 10 should preferably be softer than the plastic material of the side rings 12.

For example, the central element 10 is made of nylon, while the side rings are made of reinforced nylon.

In accordance with another aspect of the invention, in the central element 10 is completely embedded a reinforcing metal core 16, which extends between the coupling portions 14 of the side rings 12.

In a preferred embodiment, each end 16' of the metal core 16 is attached to the respective coupling portion 14 of the side ring 12.

In one embodiment, each coupling portion 14 of each side ring 12 comprises a recess 142 into which extends at least one coupling crosspiece 144. Such coupling crosspiece 144 is substantially perpendicular to the central element 10.

Each end portion of the metal core 16 forms a hook 16' which engages with the respective coupling crosspiece 144.

According to one embodiment, the metal core 16 consists of a reinforcing rod 18.

In one embodiment, in the recess 142 extend two parallel, inner and outer, coupling crosspieces 144, 146. Each hook 16' of the reinforcing rod 18 is S-shaped so as to engage both the coupling crosspieces 144, 146, passing over the outer crosspiece 144 and under the inner crosspiece 146. In this way, during the molding of the bit, the side rings 12 and the reinforcing rod 18 maintain a fixed and stable position, while the plastic material of the central element 10 is cast around the reinforcing rod 18 and onto the coupling portions 14 of the side rings 12.

In one embodiment, each side ring 12 is D-shaped, with the straight side adjacent to the end 10' of the central element 10.

In one embodiment, in each side ring 12, two or more through-holes 20, 20*a*, 20*b* are made around the center of the side ring to connect the side ring 12 to reins, bridles, ropes, chains, etc., for example to implement different levers on the horse.

In addition, a method for manufacturing the bit described above is object of the invention.

First, the two side rings 12 are made, for example out of plastic material by molding.

The two side rings are thus positioned in a special mold for molding plastic materials so that the reciprocal position of said side rings in the mold coincides substantially with the reciprocal position of the side rings in the finished bit.

At this point, the central element is molded out of plastic material in the mold so that the ends of the central element are molded over and around the coupling portions of the side rings.

In a preferred embodiment, before the step of casting the plastic material for forming the central element, a reinforcing metal core, which extends between the two side rings, is positioned in the mold.

The plastic material is then cast around the reinforcing metal core so that it is completely embedded in the plastic material of the central element.

The bit according to the invention is comfortable for the horse due to its shape, lightness and the softness of the materials used to manufacture it, in particular the plastic material of the central element.

The slightly curved and flattened shape of the central element and the slightly diverging side rings increase the comfort of the horse.

The overmolding of the central element on the side rings to form a single body makes it possible to improve the rider's control of the horse, especially when starting training. The horse feels more guided with a single-piece bit.

The absence of holes at the ends of the central element in which the side rings are inserted makes it possible to avoid the risk of the horse's lip or tongue being pinched by the bit.

The presence of the reinforcing metal core, in addition to reinforcing the central element, helps to securely anchor the central element to the side rings.

Moreover, the rod-shaped metal core is firmly supported by the side rings in the mold before and during casting of the plastic material to form the central element.

The side rings, provided with several peripheral openings separated from each other, allow the connection, even simultaneous, of bridles, reins, chains and ropes.

To the embodiments of the bit according to the invention, one skilled in the art may, to satisfy contingent needs, make modifications, adaptations and substitutions of some elements with others that are functionally equivalent, without departing from the scope of the following claims. Each of the features described as belonging to a possible embodiment may be implemented independently from the other described embodiments.

The invention claimed is:

1. A bit for horses, comprising a central element suitable for being inserted into a horse's mouth, and two side rings, each side ring being connected to a respective end of the central element for connection to reins, wherein the central element is made of a plastic material and each end of the central element is overmolded on coupling portions of a respective side ring, wherein a reinforcing metal core, extending between the coupling portions of the two side rings, is completely embedded in the central element, wherein each end of the reinforcing metal core is fastened to a respective coupling portion of each side ring, wherein each coupling portion of each side ring comprises a recess wherein at least one coupling crosspiece extends, and wherein an end of the reinforcing metal core forms a hook that engages said at least one coupling crosspiece and wherein, in the recess, two parallel, inner and outer coupling crosspieces extend, and wherein said hook is S-shaped to engage both inner and outer coupling crosspieces passing over an outer crosspiece and under an inner crosspiece.

2. The bit of claim 1, wherein the central element is formed by a straight or slightly curved bar, and wherein the two side rings form an angle equal to or greater than 90° with the central element.

3. The bit of claim 1, wherein each side ring is made of plastic material.

4. The bit of claim 3, wherein the plastic material of the central element is softer than the plastic material of the two side rings.

5. The bit of claim 1, wherein the reinforcing metal core is a reinforcing rod.

6. The bit of claim 1, wherein two or more through-openings are formed around the center of each side ring for connecting to reins, bridles, ropes or chains.

7. A method for making a bit for horses comprising a central element suitable for being inserted into a horse's mouth, and two side rings, each side ring being connected to a respective end of the central element for connection to reins, wherein the central element is made of a plastic material and each end of the central element is overmolded on coupling portions of a respective side ring, the method comprising the steps of:

making two side rings;

positioning the two side rings in a mold for molding plastic material so that reciprocal position of said two side rings in the mold coincides with the reciprocal position of the two side rings in the bit;

molding the central element made of plastic material in said mold so that ends of the central element are molded over and around the coupling portions of the two side rings, wherein a reinforcing metal core, extending between the coupling portions of the two side rings, is completely embedded in the central element, wherein each end of the reinforcing metal core is fastened to a respective coupling portion of each side ring, wherein each coupling portion of each side ring comprises a recess wherein at least one coupling crosspiece extends, and wherein an end of the reinforcing metal core forms a hook that engages said at least one coupling crosspiece and wherein, in the recess, two parallel, inner and outer coupling crosspieces extend, and wherein said hook is S-shaped to engage both inner and outer coupling crosspieces passing over an outer crosspiece and under an inner crosspiece.

8. The method of claim 7, wherein, prior to casting plastic material for molding the central element, a reinforcing metal core extending between the two side rings is positioned in the mold, the plastic material being cast around the reinforcing metal core.

* * * * *